US008884601B2

(12) United States Patent
Saxena et al.

(10) Patent No.: US 8,884,601 B2
(45) Date of Patent: Nov. 11, 2014

(54) SYSTEM AND METHOD FOR A LOW VOLTAGE BANDGAP REFERENCE

(75) Inventors: Saurabh Saxena, Noida (IN); Vivek Verma, Raipur (IN)

(73) Assignee: STMicroelectronics International N.V., Amsterdam (NL)

( * ) Notice: Subject to any disclaimer, the term of this patent is extended or adjusted under 35 U.S.C. 154(b) by 243 days.

(21) Appl. No.: 13/339,725

(22) Filed: Dec. 29, 2011

(65) Prior Publication Data

US 2013/0169259 A1 Jul. 4, 2013

(51) Int. Cl.

| | |
|---|---|
| ***G05F 3/16*** | (2006.01) |
| ***G05F 3/20*** | (2006.01) |
| ***G05F 1/10*** | (2006.01) |
| ***G05F 3/02*** | (2006.01) |

(52) U.S. Cl.
USPC ..... 323/313; 327/539

(58) Field of Classification Search
USPC ..... 323/312–317, 281, 907; 327/538–543
See application file for complete search history.

(56) References Cited

U.S. PATENT DOCUMENTS 7,161,340 B2 * 1/2007 Chiu ..... 323/316
7,541,862 B2 * 6/2009 Fujisawa et al. ..... 327/539
2006/0125460 A1 * 6/2006 Mheen et al. ..... 323/313
2009/0072914 A1 * 3/2009 Murata ..... 331/57
2009/0121912 A1 * 5/2009 Zanchi et al. ..... 341/172

OTHER PUBLICATIONS

Weili, et al., "A Sub-1-V Linear CMOS Bandgap Voltage Reference," Microelectronic Research & Development Center of Shanghai University, 4 pages, 2006.

* cited by examiner

*Primary Examiner* — Timothy J Dole
*Assistant Examiner* — Carlos Rivera-Perez
(74) *Attorney, Agent, or Firm* — Slater & Matsil, L.L.P.

(57) ABSTRACT

In accordance with an embodiment, a reference voltage generator includes a first current generator and a second current generator. The first current generator is configured to produce a first current proportional to a current through a first diode connected in series with the first resistance coupled between a first voltage and a second voltage, such that the first current is produced according to a first proportionality constant. The second current generator is configured to produce a second current proportional to a current through a second diode connected in series with the second resistance coupled between the first voltage and the second voltage, such that the second current is produced according to a second proportionality constant. The reference voltage generator further includes a reference resistor coupled to the first and second current generators and to and output of the reference voltage generator.

29 Claims, 3 Drawing Sheets

SYSTEM AND METHOD FOR A LOW VOLTAGE BANDGAP REFERENCE

TECHNICAL FIELD

This invention relates generally to semiconductor circuits and methods, and more particularly to a system and method for a low voltage bandgap reference.

BACKGROUND

Bandgap voltage reference generators are widely used in a variety of applications from analog and mixed signal circuits such as high precision comparators and A/D converters, to digital circuits such as dynamic random access memory (DRAMs) circuits and non-volatile memory circuits. Bandgap voltage references produce a stable voltage reference having a low sensitivity to temperature by generating voltages and/or currents having positive and negative temperature coefficients, and summing these positive and negative coefficients in a manner that creates a temperature stable voltage reference. Traditionally, bandgap voltage references are fabricated using bipolar devices. For example, by summing a signal related to the base-emitter voltage $V_{BE}$ of a bipolar transistor having a voltage inversely proportional to temperature with a signal that is proportional to a difference between the base-emitter voltages $\Delta V_{BE}$ of two bipolar transistors that have a voltage proportional to temperature, a temperature stable voltage can be produced as about 1.2 volts, which is about the bandgap of silicon.

The constant trend of microelectronics toward smaller size devices having smaller chip areas has resulted in a corresponding reduction of the maximum allowable supply voltage. For example, some CMOS technologies support a maximum supply voltage of about 1.2 V, which is very close bandgap voltage of silicon. As a result, bandgap references have been adapted to operate under lower voltage conditions to support these lower supply voltages. As supply voltages have continued to be reduced below 1V and begin to approach the nominal base-emitter voltages of silicon bipolar transistors, maintaining headroom within the bandgap voltage has become more challenging.

SUMMARY OF THE INVENTION

In accordance with an embodiment, a reference voltage generator includes a first current generator and a second current generator. The first current generator is configured to produce a first current proportional to a current through a first diode connected in series with the first resistance coupled between a first voltage and a second voltage, such that the first current is produced according to a first proportionality constant. The second current generator is configured to produce a second current proportional to a current through a second diode connected in series with the second resistance coupled between the first voltage and the second voltage, such that the second current is produced according to a second proportionality constant. The reference voltage generator further includes a reference resistor coupled to the first and second current generators and to and output of the reference voltage generator.

In accordance with a further embodiment, a bandgap reference circuit includes a reference resistor coupled to an output of the bandgap reference circuit, a first reference branch having a first diode coupled in series with a first resistor, a first feedback circuit that replicates a voltage across the first resistor upon a first replica resistor, and mirrors a current through the first replica resistor to the reference resistor. The bandgap reference circuit further includes a second reference branch having a second diode coupled in series with a second resistor, and a second feedback circuit that replicates a voltage across the second resistor upon a second replica resistor, and mirrors a current through the second replica resistor to the reference resistor.

In accordance with another embodiment of the present invention, a bandgap voltage reference includes a reference resistor coupled to an output of the bandgap reference circuit, a first reference branch having a first diode coupled in series with the first resistor. The first reference branch is coupled between a supply voltage and a ground voltage. The bandgap voltage reference further includes a first transistor, and a first amplifier having a first input coupled to the first resistor, a second input coupled to an output node of the first transistor, and the output of the first amplifier coupled to a control node of the first transistor. The bandgap voltage reference further includes a second resistor coupled between the output node of the first transistor and the supply voltage, a second transistor having a control node coupled to the control node of the first transistor and an output node coupled to the reference resistor, a second reference branch having a second diode coupled in series with a third resistor, where the second reference branch coupled between the supply voltage and the ground voltage. Also included is a third transistor, a second amplifier having a first input coupled to the third resistor, a second input coupled to an output node of the third transistor and an output coupled to a control node of the third transistor. In an embodiment, the voltage reference further includes a fourth resistor coupled between the output node of the third transistor and supply voltage, and a fourth transistor having a control node coupled to the control node of the third transistor and an output node coupled to the reference resistor.

In accordance with a further embodiment of the present invention, a method of operating a bandgap voltage reference includes generating a first current proportional to a current through a first diode device connected in series with a first resistance coupled between a first voltage and a second voltage. Generating the first current includes using a first feedback circuit to buffer a voltage across the first resistance to a second resistance. The method further includes mirroring a current though the second resistance to a reference resistance, and generating a second current proportional to a current though a second diode device connected in series with a third resistance coupled between the first voltage and the second voltage, where generating the second current comprising using a second feedback circuit to buffer a voltage across the third resistance to a fourth resistance. The method further includes mirroring a current through the fourth resistance to the reference resistance, and producing a reference voltage across the reference resistance.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, a low voltage bandgap reference for use in a low voltage complementary metal oxide semiconductor (CMOS). The invention may also be applied to reference voltage generators in other process types.

Figure 1:
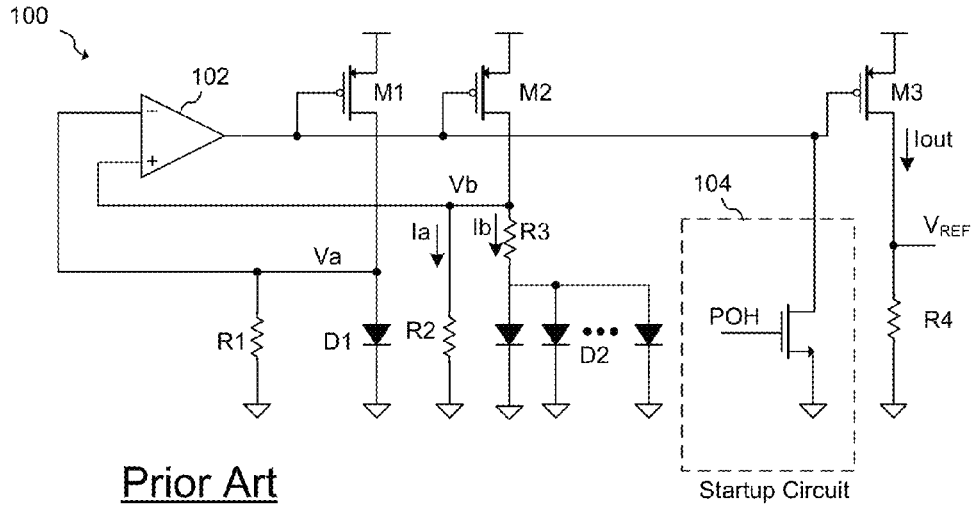
FIG. 1 illustrates a voltage reference circuit according to the prior art.

FIG. 1 illustrates a low voltage bandgap reference circuit 100 according to the prior art. Here, amplifier 102 adjusts the gate voltage of transistors M1 and M2 such that voltages Va and Vb are approximately equal; therefore, voltage Vb is driven to be approximately Va, which is the diode voltage of diode D1 having a temperature coefficient that is inversely proportional to temperature. In many cases, diodes D1 and D2 are implemented using vertical PNP bipolar transistors in a CMOS process. In a silicon CMOS process, the temperature coefficient of base-emitter voltage $V_{BE}$ of a bipolar transistor is approximately −2 mV/° C. Since voltage Vb has a negative temperature coefficient, the current Ia though resistor R2 also has a negative temperature coefficient. R3 and D2 are sized such that current Ib, has a positive temperature coefficient such that the sum of the currents Ia and Ib, when passed through a resistor, is roughly independent of temperature. Consequently, current Iout produced by M3 is proportional to the sum of the currents Ia and Ib and, when passed through a resistor, gives a voltage that is roughly independent of temperature, such that output voltage VREF is about the product of Iout and R4. Startup circuit 104 is provided to ensure that the bandgap voltage reference is operational at startup.

As the supply voltage is decreased and the supply voltage approaches voltages Va and Vb (i.e. the diode voltage or the base-emitter voltage of the bipolar devices used as diodes), transistors M1 and M2 are operated with lower and lower source-drain voltage causing the devices to leave the saturation region resulting in output voltage errors. This is due to the dependence of MOS current on the drain voltage in linear/subthreshold and the drain voltage difference in the current mirrors.

With respect to the circuit of FIG. 1, the fundamental equation for bandgap reference generation is:

$$V_{REF} = R4\cdot\left(\frac{Vf1}{R2} + \frac{\Delta Vf}{R3}\right), \tag{1}$$

which can also be expressed as:

$$V_{REF}=\alpha_1 V1+\alpha_2 V2,$$

where V1 is voltage having negative temperature coefficient, such as a base-emitter voltage $V_{BE}$, and V2 is a voltage having as positive temperature coefficient such as $\Delta V_{BE}$ of two bipolar transistors, or:

$$V_{REF}=\alpha_1 V_{BE}+\alpha_2 \Delta V_{BE}. \tag{2}$$

Equation (2) can also be expressed as:

$$V_{REF}=(\alpha_1+\alpha_2)V_{BE1}-\alpha_2 V_{BE2}, \tag{3}$$

or:

$$V_{REF}=(\alpha_2)V_{BE1}+(\alpha_1-\alpha_2)V_{BE2}, \tag{4}$$

where, $$\Delta V_{BE}=V_{BE1}-V_{BE2}.$$

It should be appreciated that the coefficients of $V_{BE1}$ and $V_{BE2}$ could be independently set in order to achieve cancellation of temperature coefficient of $V_{REF}$.

Figure 2:
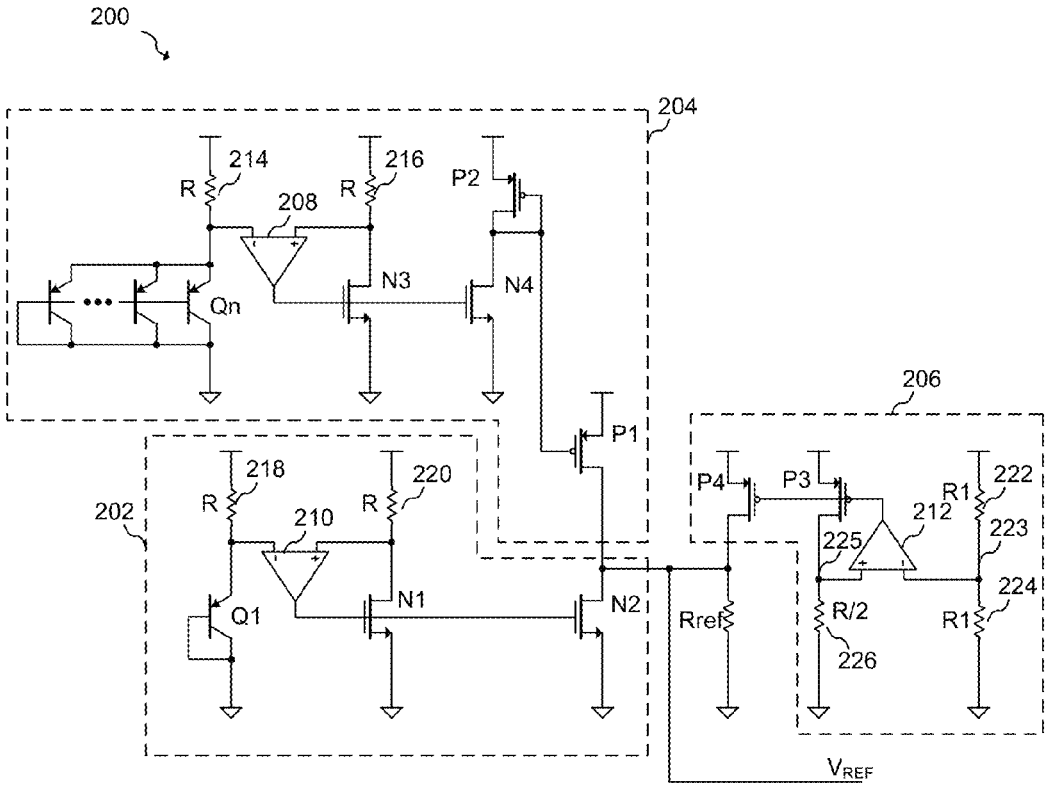
FIG. 2 illustrates a voltage reference circuit according to an embodiment of the present invention.

FIG. 2 illustrates a voltage reference 200 according to an embodiment of the present invention in which equation (3) is implemented. For voltage reference 200, $$V_{REF} = Rref\left(\beta_2\frac{(V_{DD}-V_{BE2})}{R} - \beta_1\frac{(V_{DD}-V_{BE1})}{R} + (\beta_1-\beta_2)\frac{V_{DD}}{R}\right), \tag{5}$$

where $V_{DD}$ is the supply voltage, $V_{BE1}$ is the base-emitter voltage of Q1, $V_{BE2}$ is the base-emitter voltage of Qn, and $\beta_1$ and $\beta_2$ are proportionality constants. Equation (5) may be written as, $$V_{REF} = Rref\left(\beta_1\frac{(V_{BE1})}{R} - \beta_2\frac{(V_{BE2})}{R}\right), \tag{6}$$

which is similar to equation (4) above.

In an embodiment, voltage reference 200 has three current generators that generate each of the terms in equation 5. For example, current generator 204 generates the first current term, $$\beta_2\frac{(V_{DD}-V_{BE2})}{R}$$

current generator 202 generates the second current term $$\beta_1\frac{(V_{DD}-V_{BE1})}{R},$$

and current generator 206 generates third current term $$(\beta_1-\beta_2)\frac{V_{DD}}{R}.$$

Each of the current generation circuits 204 and 202 employ feedback circuits that preserve headroom and enable voltage reference circuit 200 to operate at low supply voltages, for example 0.81V. In an embodiment, current generators 204 and 202 generate currents that are dependent on the base emitter voltages of transistors Q1 and Q2 in respectively. Current generator 206, on the other hand, produces a current term that compensates for supply voltage variation. The output of each current generator block 202, 204 and 206 are coupled to resistor Rref to produce reference voltage $V_{REF}$. In one embodiment, output voltage $V_{REF}$ is nominally about 0.43V. It should be appreciated, however that voltage reference 200 may be adapted to produce other nominal output voltages.

In an embodiment, current generator 202 has a branch having transistor Q1 and resistor 218 coupled in series between the power supply and ground. Transistor Q1, as well as transistor Qn, may be implemented using lateral PNP transistors, such as those that are supported in a standard CMOS process. In alternative embodiments of the present invention, other bipolar transistor types may be used. For example, NPN transistors and/or junction diodes may be used in place of lateral PNP transistors. Amplifier 210 is coupled to NMOS transistor N1 and resistor 220 such that the voltage across resistor 218 is imposed across resistor 220 by adjusting the gate of NMOS transistor N1 in feedback, thereby causing a current proportional to the current though resistor to flow through NMOS transistor N1. This current is mirrored to NMOS transistor N2, the drain of which is coupled to resistor Rref. In some embodiments, resistor 218 has the same resistance as resistor 220. However, in alternative embodiments of the present invention resisters 218 and 220 may have different values. The difference in resistor values 218 and 220, as well as the length to width ratios of NMOS transistors N1 and N2, may be adjusted to provide a particular proportionality constant.

Similarly, current generator 204 has a branch having transistor Qn and resistor 214 coupled in series between the power supply and ground. In an embodiment, transistor Qn has a larger area than transistor Q1. In some embodiments, transistor Qn is made of multiple unit devices that share the same geometry as transistor Q1. These unit devices may be co-located and laid out using matching techniques known in the art, for example, common centroid layout techniques. Amplifier 208 is coupled to NMOS transistor N3 and resistor 216 such that the voltage across resistor 214 is imposed across resistor 216 by adjusting the gate of NMOS transistor N3 in feedback, thereby causing a current proportional to the current through resistor 214 to flow though NMOS transistor N3. This current is mirrored to NMOS transistor N4. In the depicted embodiment, PMOS current minor is implemented PMOS devices P1 and P2 that minor the current from NMOS device N4 to resistor Rref.

Current generator 206 has a branch that includes a voltage divider made of resistors 222 and 224 coupled in series between the power supply and ground to produce a voltage that is proportional to the difference between the power supply and ground. It should be appreciated that in alternative embodiments of the present invention, other voltage divider structures or other circuits that produce a voltage proportional to the power supply voltage may also be used. Amplifier 212 is coupled to PMOS transistor P3 and to resistor 226 in feedback such that a voltage proportional to the difference between the power supply and ground is imposed upon resistor 226. The current through PMOS transistor P3 is mirrored to PMOS transistor P4 to resistor Rref.

The current produced by current generator 206 may be adjusted as needed. In an embodiment, there are independent controls to adjust the current. For example, in one embodiment, this current is adjustable by adjusting the current mirror ratio of PMOS transistors P3 and P4 or by adjusting resisters 222, 224, and/or 226. In one embodiment, the ratio of resistors 222 and 224 define the voltage of node 223. The closed loop formed by amplifier 212 and PMOS device P2 ensures that the voltage at node 225 is approximately the same as node 223. Because the current generated by the generator depends on all three resistors 222, 224, and or 226, the mirror ratio may also be adjusted by resistors 222, 224, and/or 226 as well as adjusting the relative width to length ratios of PMOS devices P3 and P4. By adjusting the output of current generator 206, the output voltage of a voltage generator 200 may be adjusted, and the supply dependence of current generators 202 and 204 may be compensated.

In an embodiment, resistors 214, 216, 218, and 220 have a same value of R, and resistor 226 has a value that is R/2. In one embodiment, R is approximately 62 kΩ, however, other values greater or less than 62 kΩ may be used. Alternatively, some or all of resistors 214, 216, 218, 220 and 226 may have different values. In an embodiment of the present invention, the output voltage and temperature behavior of voltage reference 200 may be tuned in adjusted via resistor values or by current mirror ratios. For example, the current mirror ratios of transistors N1 and N2, N3 and N4, P1 and P2, P3 and/or P4 may be adjusted. In some embodiments of the present invention, a startup circuit may be used to ensure that the voltage reference 200 starts up reliably when power is first applied.

In alternative embodiments of the present invention, the structure of voltage reference 200 may be varied. For example, resisters 214, 216, 218, and 220 may be coupled to ground instead of to the power supply, and transistors N1, N2, N3 and N4 may be implemented using PMOS transistors instead of NMOS transistors. Similarly, current generator 206 may be implemented using NMOS transistors instead of PMOS transistors P3 and P4. In such cases, reference voltage $V_{REF}$ may be referenced to the supply voltage, which is a different voltage other than ground. Furthermore, in some embodiments, some or all of the current mirrors implemented by transistors N1, N2, N3, N4, P1, P2, P3 and P4 may be implemented using cascoded devices. Other methods of mirroring and adding the various currents may also be used. This architecture is based on a single supply but more than one supply could be used and in that case, some blocks may be referenced to different supplies.

Figure 3:
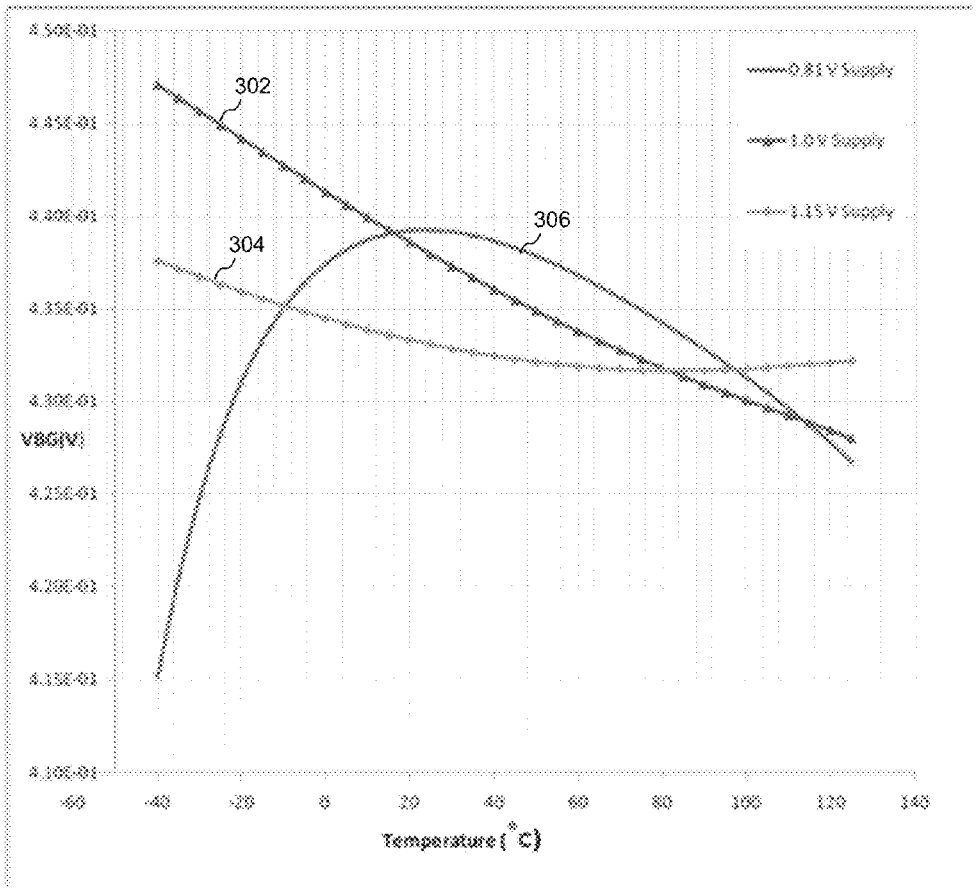
FIG. 3 illustrates a waveform diagram showing the performance an embodiment voltage reference over supply and temperature.

Turning to FIG. 3, a waveform diagram showing the simulated performance of an embodiment voltage reference circuit is illustrated. Trace 302 shows the voltage versus temperature performance of an embodiment voltage reference circuit with a power supply voltage of 1.0 V; trace 304 shows the voltage versus temperature performance of an embodiment voltage reference circuit with a power supply voltage of 1.15 V; and trace 306 shows the voltage versus temperature performance of the embodiment voltage reference circuit with the power supply voltage of 0.81 V. Here, the nominal output voltage is between about 434 mV and 440 mV at 20° C. It should be appreciated that in alternative embodiments of the present invention other voltage and temperature characteristics may be achieved.

Figure 4:
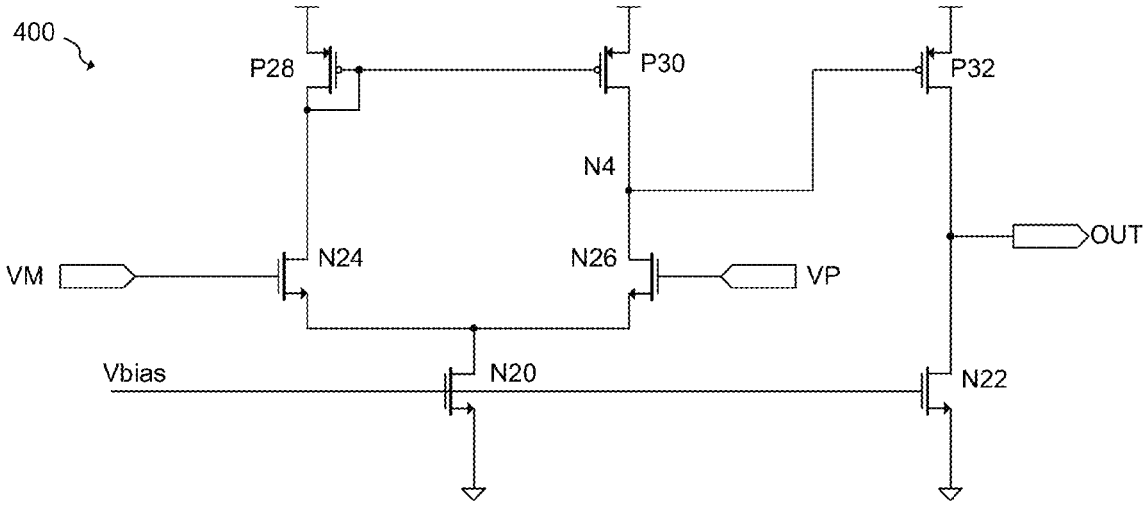
FIG. 4 illustrates and embodiment amplifier for use in the voltage reference circuit.

FIG. 4 illustrates a schematic of an embodiment two-stage CMOS amplifier 400 that may be used to implement amplifiers 208, 210 and 212. Amplifier 400 has NMOS devices N24 and N26 coupled in a differential pair configuration biased by NMOS current source N20. The differential pair is loaded by active load PMOS transistors P28 and P30. The drains of N26 and P30 are coupled to PMOS transistor P32 which is loaded by current source transistor N22, and the output of amplifier 400 is taken from the drains of transistors P32 and N22. Alternatively, the device types shown in FIG. 4 may be inverted. For example, in an alternative embodiment, the input differential pair may be implemented using PMOS devices instead of NMOS devices, the current source transistors and active loads may in implemented using NMOS devices instead of PMOS devices. It should be appreciated that amplifier 400 is just one example of the many possible amplifier circuits that may be used for amplifiers 208, 210 and 212. In alternative embodiments, other amplifier circuits known in the art may be used.

In accordance with an embodiment, a reference voltage generator includes a first current generator and a second current generator. The first current generator is configured to produce a first current proportional to a current through a first diode connected in series with the first resistance coupled between a first voltage and a second voltage, and the first current generator produces the first current according to a first proportionality constant. The second current generator is configured to produce a second current proportional to a current through a second diode connected in series with the second resistance coupled between the first voltage and the second voltage, and the second current generator produces the second current according to a second proportionality constant. The reference voltage generator further includes a reference resistor coupled to the first and second current generators and to and output of the reference voltage generator. In an embodiment, the second diode device comprises a larger area than the first diode device, and, in some embodiments, the first voltage comprises a power supply voltage and the second voltage comprises a ground voltage.

In an embodiment, the first current generator is configured to generate the first current proportional to the base-emitter of a bipolar device and an operational amplifier is used to mirror this current in an NMOS transistor for further manipulation. Accordingly, the second current generator is further configured to generate the second current proportional to the base-emitter of a second bipolar device and a second operational amplifier is used to mirror this current in a second NMOS transistor for further manipulation. In an embodiment, the resistors in a diode branch and a mirror branch are matched.

In an embodiment, the first proportionality constant and the second proportionality constant are chosen to reduce a voltage versus temperature sensitivity of the output of the reference voltage generator.

In an embodiment, the reference voltage generator further includes a third current generator configured to produce a third current proportional to a voltage difference between the first voltage and the second voltage divided by a third resistor value. The reference resistor may be further coupled to the third current generator. The third current generator may produce the third current according to a third proportionality constant, such that the third proportionality constant is chosen to reduce a sensitivity of the output voltage generator to the voltage difference between the first voltage and the second voltage.

In some embodiments, the first diode device may be implemented using a first bipolar transistor, the second diode device may be implemented using a second bipolar transistor, and the third proportionality constant may be fine-tuned to reduce a further dependence of the voltage difference between the first voltage and the second voltage embedded within base-emitter voltages of the first and second bipolar transistors. In some embodiments, the third proportionality constant is adjustable.

In an embodiment, the first reference current generator includes a first transistor coupled in series with a first replica resistor, a first amplifier having a first input coupled between the first diode device and the first resistance, a second input coupled between the first transistor and the first replica resistor, and an output coupled to a control input of the first transistor, and a first current mirror configured to mirror a current of the first transistor to the reference resistor. The second reference current generator may include a second transistor coupled in series with a second replica resistor, a second amplifier having a first input coupled between the second diode device and the second resistance, a second input coupled between the second transistor and the second replica resistor, and an output coupled to a control input of the second transistor, and a second current mirror configured to mirror a current of the second transistor to the reference resistor.

In some embodiments, the reference voltage generator further includes a third current generator configured to produce a third current proportional to a current through a third resistor coupled between a current proportional to a voltage difference between the first voltage and the second voltage. The reference resistor may be further coupled to the third current generator. In some embodiments, the third current generator includes a third transistor coupled in series with a third replica resistor, a third amplifier having a first input coupled between a fourth resistor coupled to the first voltage and a fifth resistor coupled to the second voltage, and a second input coupled between the third transistor and the third replica resistor, and an output coupled to a control input of the third transistor, and a third current mirror configured to mirror a current of the third transistor to the reference resistor.

In an embodiment, the first diode device comprises a first diode connected bipolar transistor, and the second diode device comprises a second diode connected transistor comprising a plurality of diode connected bipolar transistors coupled in parallel. In some embodiments, the first current is inversely proportional to a base-emitter voltage of the first diode connected bipolar transistor, and the second current is inversely proportional of a base-emitter voltage of the second diode connected bipolar transistor.

In accordance with a further embodiment, a bandgap reference circuit includes a reference resistor coupled to an output of the bandgap reference circuit, a first reference branch having a first diode coupled in series with a first resistor, a first feedback circuit that replicates a voltage across the first resistor upon a first replica resistor, and mirrors a current through the first replica resistor to the reference resistor. The bandgap reference circuit further includes a second reference branch having a second diode coupled in series with a second resistor, and a second feedback circuit that replicates a voltage across the second resistor upon a second replica resistor, and mirrors are current through the second replica resistor to the reference resistor.

In some embodiments, the first reference branch is coupled between a first power supply voltage and a second power supply voltage, and the second reference branch is coupled between the first power supply voltage and the second power supply voltage. The first feedback circuit may include a first reference transistor having an output node coupled to the first replica resistor, a first amplifier having a first input coupled to the first resistor, a second input coupled to the first replica resistor, an output coupled to a control node of the first transistor, and a first mirror transistor having a control node coupled to the control node of the first reference transistor. Similarly, the second feedback circuit may include a second reference transistor having an output node coupled to the second replica transistor, a second amplifier having a first input coupled to the second resistor, a second input coupled to the second replica resistor, an output coupled to a control node of the second transistor, and a second mirror transistor having a control node coupled to the control node of the second reference transistor.

In an embodiment, the bandgap reference circuit further includes a voltage divider circuit producing a third voltage proportional to a voltage difference between the first power supply voltage and the second power supply voltage, and a third feedback circuit that replicates the third voltage across a third resistor and mirrors a current through the third resistor to the reference resistor. The third feedback circuit may include a third reference transistor having an output node coupled to the third resistor, a third amplifier having a first input coupled to the voltage divider circuit, a second input coupled to the third resistor, and an output coupled to a control node of the third transistor, and a third mirror transistor having a control node coupled to the control node of the third reference transistor.

In an embodiment, the first diode device includes a diode connected bipolar transistor; and the second diode device comprises a plurality of diode connected bipolar transistors coupled in parallel.

In accordance with another embodiment of the present invention, a bandgap voltage reference includes a reference resistor coupled to an output of the bandgap reference circuit, a first reference branch having a first diode coupled in series with the first resistor. The first reference branch is coupled between a supply voltage and a ground voltage. The bandgap voltage reference further includes a first transistor; and a first amplifier having a first input coupled to the first resistor, a second input coupled to an output node of the first transistor, and an output coupled to a control node of the first transistor. The bandgap voltage reference further includes a second resistor coupled between the output node of the first transistor and the supply voltage, a second transistor having a control node coupled to the control node of the first transistor and an output node coupled to the reference resistor, a second reference branch having a second diode coupled in series with a third resistor, where the second reference branch coupled between the supply voltage and the ground voltage. Also included is a third transistor, a second amplifier having a first input coupled to the third resistor, a second input coupled to an output node of the third transistor, and an output coupled to a control node of the third transistor. In an embodiment, the voltage reference also includes a fourth resistor coupled between the output node of the third transistor and supply voltage, and a fourth transistor having a control node coupled to the control node of the third transistor and an output node coupled to the reference resistor.

In an embodiment, the first, second third and fourth transistors comprise NMOS transistors. The first diode may be implemented using a first diode connected bipolar device, the second diode may be implemented using a plurality of diode connected bipolar devices. In some embodiments, the diode connected bipolar devices are lateral PNP devices.

In some embodiments, the bandgap voltage reference further includes a current mirror coupled between the output node of the fourth transistor and the reference resistor. Furthermore, the bandgap voltage reference may also include a voltage divider circuit coupled between the supply voltage and the ground voltage; a fifth transistor; a third amplifier having a first input coupled to an output of the voltage divider, a second input coupled to an output node of the fifth transistor, and an output coupled to a control node of the fifth transistor; a fifth resistor coupled to the output node of the fifth transistor; and a sixth transistor having a control node coupled to the control node of the fifth transistor and an output node coupled to the reference resistor. In some embodiments, the fifth resistor is coupled between the output node of the fifth transistor and the ground voltage. The fifth and sixth transistors may be implemented using PMOS transistors.

In accordance with a further embodiment of the present invention, a method of operating a bandgap voltage reference includes generating a first current proportional to a current through a first diode device connected in series with a first resistance coupled between a first voltage and a second voltage. Generating the first current includes using a first feedback circuit to buffer a voltage across the first resistance to a second resistance. The method further includes mirroring a current though the second resistance to a reference resistance, and generating a second current proportional to a current though a second diode device connected in series with a third resistance coupled between the first voltage and the second voltage, where generating the second current comprising using a second feedback circuit to buffer a voltage across the third resistance to a fourth resistance. The method further includes mirroring a current through the fourth resistance to the reference resistance, and producing a reference voltage across the reference resistance.

In an embodiment, the method may further include generating a compensating current proportional to a difference between the first voltage and the second voltage, and mirroring the compensating current to the reference resistance, wherein the compensating current compensates for an effect of the difference between the first voltage and the second voltage on the reference voltage.

Advantages of embodiments of the present invention that utilize feedback circuits to produce reference currents include the ability to produce a reference voltage that is stable over power supply and temperature in the presence of very low power supply voltages. Another advantageous aspect of the present invention is that the devices remain in the saturation region even under low power supply voltage conditions, for example, in embodiments where the headroom is defined by a voltage drop across a diode.

A further advantage of embodiments include the ability to achieve a bandgap circuit that has a minimum supply voltage comparable to a diode junction voltage and/or a Vbe of transistor.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A reference voltage generator comprising:

a first current generator configured to produce a first current proportional to a current through a first diode device directly connected in series with a first resistance, wherein a series combination of the first diode device and the first resistance is directly connected between a first supply node and a second supply node, and the first current generator produces the first current according to a first proportionality constant;

a second current generator configured to produce a second current proportional to a current though a second diode device directly connected in series with a second resistance, wherein a series combination of the second diode device and the second resistance is directly connected between the first supply node and the second supply node, and the second current generator produces the second current according to a second proportionality constant; and a reference resistor coupled to the first and second current generators and to an output of the reference voltage generator.

2. The reference voltage generator of claim 1, wherein the first proportionality constant and the second proportionality constant are chosen to reduce a voltage versus temperature sensitivity of the output of the reference voltage generator.

3. The reference voltage generator of claim 1, wherein the second diode device comprises a larger area than the first diode device.

4. The reference voltage generator of claim 1, further comprising a third current generator configured to produce a third current proportional to a voltage difference between a voltage of the first supply node and a voltage of the second supply node divided by a third resistor value, wherein the reference resistor is further coupled to the third current generator.

5. The reference voltage generator of claim 4, wherein the third current generator produces the third current according to a third proportionality constant, the third proportionality constant chosen to reduce a sensitivity of the output voltage generator to the voltage difference between the voltage of the first supply node and the voltage of the second supply node.

6. The reference voltage generator of claim 5, wherein the third proportionality constant is adjustable.

7. The reference voltage generator of claim 5, wherein the first supply node comprises a power supply node and the second supply node comprises a ground node.

8. The reference voltage generator of claim 5, wherein the first diode device comprises a first bipolar transistor;

the second diode device comprises a second bipolar transistor; and the third proportionality constant is fine tuned to reduce a further dependence of the voltage difference between the voltage of the first supply node and the voltage of the second supply node embedded within base-emitter voltages of the first and second bipolar transistors.

9. The reference voltage generator of claim 1, wherein:

the first current generator comprises:

a first transistor coupled in series with a first replica resistor, a first amplifier having a first input coupled between the first diode device and the first resistance, a second input coupled between the first transistor and the first replica resistor, and an output coupled to a control input of the first transistor, and a first current mirror configured to mirror a current of the first transistor to the reference resistor; and the second current generator comprises:

a second transistor coupled in series with a second replica resistor, a second amplifier having a first input coupled between the second diode device and the second resistance, a second input coupled between the second transistor and the second replica resistor, and an output coupled to a control input of the second transistor, and a second current mirror configured to mirror a current of the second transistor to the reference resistor.

10. The reference voltage generator of claim 9, further comprising a third current generator configured to produce a third current proportional to a current through a third resistor coupled between a current proportional to a voltage difference between voltage of the first supply node and a voltage of the second supply node, wherein the reference resistor is further coupled to the third current generator and the third current generator comprises:

a third transistor coupled in series with a third replica resistor, a third amplifier having a first input coupled between a fourth resistor coupled to the first supply node and a fifth resistor coupled to the second supply node, and a second input coupled between the third transistor and the third replica resistor, and an output coupled to a control input of the third transistor, and a third current mirror configured to minor a current of the third transistor to the reference resistor.

11. The reference voltage generator of claim 1, wherein:

the first diode device comprises a first diode connected bipolar transistor; and the second diode device comprises a second diode connected bipolar transistor comprising a plurality of diode connected bipolar transistors coupled in parallel.

12. The reference voltage generator of claim 11, wherein:

the first current is inversely proportional to a base-emitter voltage of the first diode connected bipolar transistor; and the second current is inversely proportional to a base-emitter voltage of the second diode connected bipolar transistor.

13. A bandgap reference circuit comprising:

a reference resistor coupled to an output of the bandgap reference circuit;

a first reference branch having a first diode directly connected in series with a first resistor, wherein a series combination of the first diode and the first resistor is directly connected between a first power supply node and a second power supply node;

a first feedback circuit that replicates a voltage across the first resistor upon a first replica resistor and mirrors a first current through the first replica resistor to the reference resistor;

a second reference branch having a second diode directly connected in series with a second resistor, wherein a series combination of the second diode and the second resistor is directly connected between the first power supply node and the second power supply node; and a second feedback circuit that replicates a voltage across the second resistor upon a second replica resistor and mirrors a second current through the second replica resistor to the reference resistor.

14. The bandgap reference circuit of claim 13, wherein:

the first feedback circuit comprises a first reference transistor having an output node coupled to the first replica resistor, a first amplifier having a first input coupled to the first resistor, a second input coupled to the first replica resistor, an output coupled to a control node of the first transistor, a first mirror transistor having a control node coupled to the control node of the first reference transistor; and the second feedback circuit comprises a second reference transistor having an output node coupled to the second replica resistor, a second amplifier having a first input coupled to the second resistor, a second input coupled to the second replica resistor, an output coupled to a control node of the second transistor, a second mirror transistor having a control node coupled to the control node of the second reference transistor.

15. The bandgap reference circuit of claim 14, further comprising:

a voltage divider circuit producing a third voltage proportional to a voltage difference between a voltage of the first power supply node and a voltage of the second power supply node; and a third feedback circuit that replicates the third voltage across a third resistor and mirrors a third current through the third resistor to the reference resistor.

16. The bandgap circuit of claim 15, wherein the third feedback circuit comprises a third reference transistor having an output node coupled to the third resistor, a third amplifier having a first input coupled to the voltage divider circuit, a second input coupled to the third resistor, and an output coupled to a control node of the third transistor, a third minor transistor having a control node coupled to the control node of the third reference transistor.

17. The bandgap circuit of claim 13, wherein:

the first diode comprises a diode connected bipolar transistor; and the second diode comprises a plurality of diode connected bipolar transistors coupled in parallel.

18. The bandgap circuit of claim 13, wherein:

the first current is inversely proportional to a diode voltage of the first diode; and the second current is inversely proportional to a diode voltage of the second diode.

19. A bandgap voltage reference comprising:

a reference resistor coupled to an output of the bandgap voltage reference;

a first reference branch having a first diode directly connected in series with a first resistor, wherein a series combination of the first diode and the first resistor is directly connected between a supply node and a ground node;

a first transistor;

a first amplifier having a first input coupled to the first resistor, a second input coupled to an output node of the first transistor, and an output coupled to a control node of the first transistor;

a second resistor coupled between the output node of the first transistor and the supply node;

a second transistor having a control node coupled to the control node of the first transistor and an output node coupled to the reference resistor;

a second reference branch having a second diode directly connected in series with a third resistor, wherein a series combination of the second diode and the second resistor is directly connected between the supply node and the ground node;

a third transistor;

a second amplifier having a first input coupled to the third resistor, a second input coupled to an output node of the third transistor, and an output coupled to a control node of the third transistor;

a fourth resistor coupled between the output node of the third transistor and the supply node; and a fourth transistor having a control node coupled to the control node of the third transistor and an output node coupled to the reference resistor.

20. The bandgap voltage reference of claim 19, wherein the first, second, third and fourth transistors comprise NMOS transistors.

21. The bandgap voltage reference of claim 19, wherein the first diode comprises a first diode connected bipolar device; and the second diode comprises a plurality of diode connected bipolar devices.

22. The bandgap voltage reference of claim 21, wherein the diode connected bipolar devices comprise lateral PNP devices.

23. The bandgap voltage reference of claim 19, further comprising a current minor coupled between the output node of the fourth transistor and the reference resistor.

24. The bandgap voltage reference of claim 19, further comprising:

a voltage divider circuit coupled between the supply node and the ground node;

a fifth transistor;

a third amplifier having a first input coupled to an output of the voltage divider, a second input coupled to an output node of the fifth transistor, and an output coupled to a control node of the fifth transistor;

a fifth resistor coupled to the output node of the fifth transistor; and a sixth transistor having a control node coupled to the control node of the fifth transistor and an output node coupled to the reference resistor.

25. The bandgap voltage reference of claim 24, wherein the fifth resistor is coupled between the output node of the fifth transistor and the ground voltage node.

26. The bandgap voltage reference of claim 24, wherein the fifth and sixth transistors comprise PMOS transistors.

27. A method of operating a bandgap voltage reference, the method comprising:

generating a first current proportional to a current though a first diode device directly connected in series with a first resistance, wherein a series combination of the first diode device and the first resistance is directly connected between a first supply node and a second supply node, generating the first current comprises using a first feedback circuit to buffer a voltage across the first resistance to a second resistance, and the first current is inversely proportional to a diode voltage of the first diode device;

mirroring a current though the second resistance to a reference resistance;

generating a second current proportional to a current though a second diode device directly connected in series with a third resistance, wherein a series combination of the second diode device and the third resistance is directly connected between the first supply node and the second supply node, generating the second current comprising using a second feedback circuit to buffer a voltage across the third resistance to a fourth resistance, and the second current is inversely proportional to a diode voltage of the second diode device;

mirroring a current though the fourth resistance to the reference resistance; and producing a reference voltage across the reference resistance.

28. The method of claim 27, further comprising:

generating a compensating current proportional to a difference between a voltage of the first supply node and a voltage of the second supply node; and minoring the compensating current to the reference resistance, wherein the compensating current compensates for an effect of the difference between the first voltage and the second voltage on the reference voltage.

29. A reference voltage generator comprising:

a first current generator configured to produce a first current proportional to a current through a first diode device directly connected in series with a first resistance, wherein a series combination of the first diode device and the first resistance is directly connected between a first supply node and a second supply node, the first current generator produces the first current according to a first proportionality constant, and the first current is inversely proportional to a diode voltage of the first diode device;

a second current generator configured to produce a second current proportional to a current though a second diode device connected in series with a second resistance, wherein a series combination of the second diode device and the second resistance is directly connected between the first supply node and the second supply node, the second current generator produces the second current according to a second proportionality constant, and the second current is inversely proportional to a diode voltage of the second diode device; and a reference resistor coupled to the first and second current generators and to an output of the reference voltage generator.

* * * * *

UNITED STATES PATENT AND TRADEMARK OFFICE

CERTIFICATE OF CORRECTION

PATENT NO. : 8,884,601 B2
APPLICATION NO. : 13/339725
DATED : November 11, 2014
INVENTOR(S) : Saurabh Saxena et al.

It is certified that error appears in the above-identified patent and that said Letters Patent is hereby corrected as shown below:

In the Claims

In Col. 12, line 3, claim 10, delete "configured to minor" and insert --configured to mirror--.
In Col. 13, line 66, claim 23, delete "current minor" and insert --current mirror--.

Signed and Sealed this
Third Day of March, 2015

Michelle K. Lee

Michelle K. Lee
*Deputy Director of the United States Patent and Trademark Office*